US007530333B2

(12) United States Patent
Sumner et al.

(10) Patent No.: US 7,530,333 B2
(45) Date of Patent: May 12, 2009

(54) CHILDREN'S WALKING HARNESS

(76) Inventors: Valerie A. Sumner, 10 Cedar Ave., Locust Valley, NY (US) 11560; Maureen K. Hoar, 107 Yardley Ct., Mooresville, NC (US) 28115

( * ) Notice: Subject to any disclaimer, the term of this patent is extended or adjusted under 35 U.S.C. 154(b) by 471 days.

(21) Appl. No.: 11/446,826

(22) Filed: Jun. 5, 2006

(65) Prior Publication Data

US 2006/0288957 A1 Dec. 28, 2006

Related U.S. Application Data

(60) Provisional application No. 60/595,105, filed on Jun. 6, 2005.

(51) Int. Cl.
*A62B 35/00* (2006.01)

(52) U.S. Cl. ..... 119/770; 119/857

(58) Field of Classification Search ..... 119/769, 119/770, 784, 792, 793, 795, 907, 857; 182/3; 2/310, 311, 312; D29/101.1; 482/69
See application file for complete search history.

(56) References Cited

U.S. PATENT DOCUMENTS 2,275,983 A * 3/1942 Nadeau ..... 119/770
4,308,629 A * 1/1982 Freemon ..... 441/111
4,667,624 A * 5/1987 Smith ..... 119/770
5,388,551 A * 2/1995 Martusciello ..... 119/770
5,476,070 A * 12/1995 Gwon et al. ..... 119/770
6,338,699 B1 * 1/2002 Veitch ..... 482/69
2004/0221818 A1 * 11/2004 Rother et al. ..... 119/770
2006/0150921 A1 * 7/2006 Zinger ..... 119/770

* cited by examiner

*Primary Examiner*—T. Nguyen

(57) ABSTRACT

A walking harness for children includes a band or strip with first and second free opposing ends. The band engages the torso at the first end and trails off at the second end. Shoulder straps extend from the portion that engages the torso. These have remote ends fitted to extend downwardly over the shoulders of a child to a point generally centered between the shoulder blades of the child's back. An adult can retain the one free end of the band, and the remote ends of the shoulder straps and the transition portion between the two portions together create a snug fit between the shoulder straps and the torso-engaging portion. The trailing portion extends from the central point in such a way that an adult is able to grip the second free end, thus provide a tethering restraint for a child.

14 Claims, 2 Drawing Sheets

Fig. 1
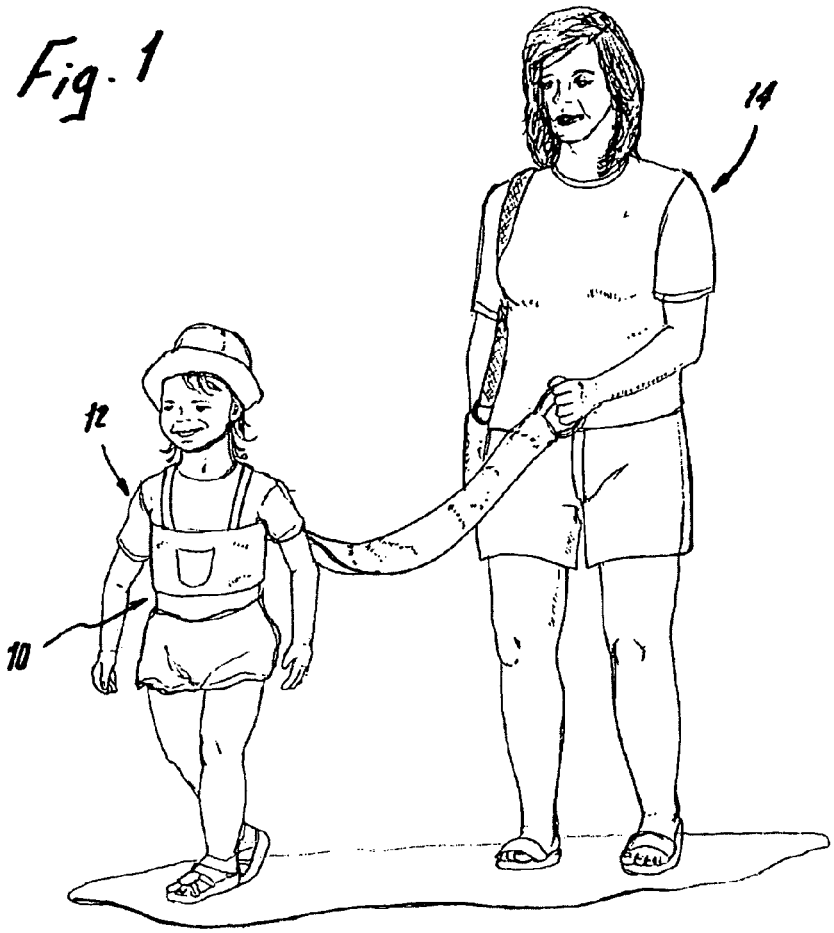
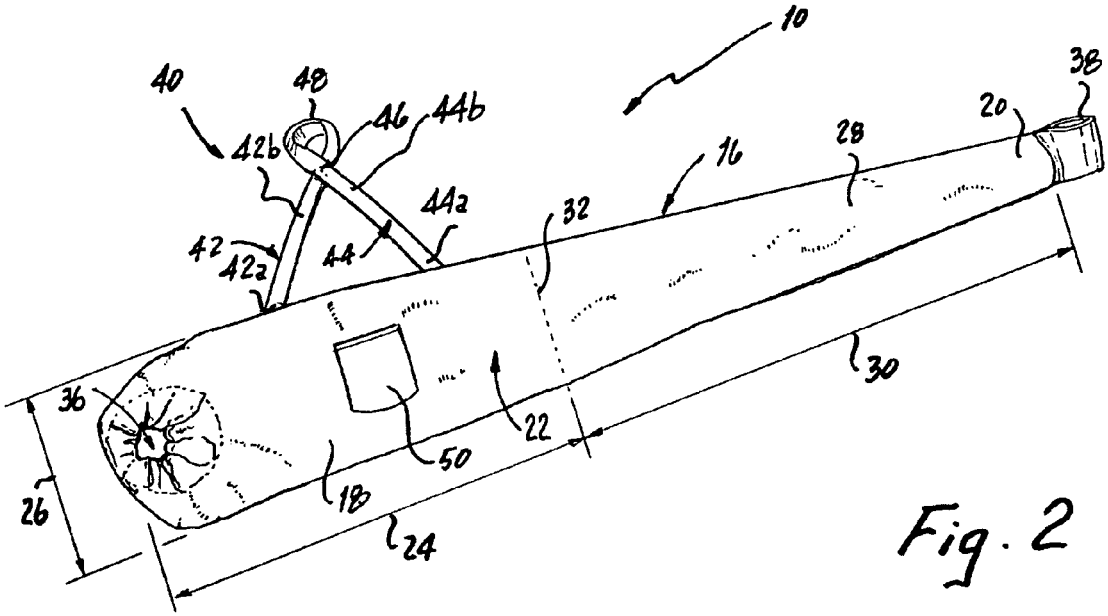
Fig. 2

CHILDREN'S WALKING HARNESS

CROSS-REFERENCE TO RELATED APPLICATION

The subject application is based on Provisional Patent Application No. 60/595,105 filed on Jun. 6, 2005, the entire contents of which are incorporated by reference. This utility application is being filed within the statutory term for claiming priority based on a provisional application.

BACKGROUND OF THE INVENTION

1. Field of the Invention

The invention generally relates to child restraints, and more specifically to a walking harness for children.

2. Description of the Prior Art

Harnesses and restraints for tethering a walking child have been known. Traditional walking harnesses typically employ hardware and other components such as Velcro®, snaps or hooks. Many such harnesses or restraints function and give the appearance of harnesses or restraints used for various domesticated animals, such as "dog leash" harnesses. Because of this similarity, most parents have refrained from using such devices because of the actual or perceived stigma that attaches to a walking harness despite the numerous benefits in terms of child safety and parental freedom.

SUMMARY OF THE INVENTION

Accordingly, it is an object of the invention to provide a walking harness for children that does not have the disadvantage of having the "dog leash" stigma associated with such prior walking harnesses or restraints.

It is still another object of the invention to provide a walking harness that is simple in construction and economical to manufacture.

It is still another object of the invention to provide a walking harness, as in the previous objects, that does not require the use of any hardware or other industrial materials such as Velcro®, snaps or hooks.

It is yet another object of the invention to provide a walking harness for children that is both effective and aesthetically pleasing.

It is a further object to provide a walking harness that can be made entirely from a generally elongate band or strip of a planar sheet material, such as durable cotton or cotton duck or canvas.

It is still a further object of the invention to provide a walking harness as in the previous object that can be made from a variety of matching patterns and can be lined with other coordinating fabrics, such as cotton poplin to impart to the product a stylish and finished appearance.

It is yet a further object of the present invention to provide a walking harness of the type under discussion that resembles a halter or apron with a long flowing scarf that can be held by a parent or other caregiver.

It is an additional object of the invention to provide a walking harness that is easy and convenient to maintain and use.

It is still an additional object of the invention to provide a walking harness that is completely adjustable and self-adjusting despite the fact that no hardware or other industrial materials are used.

It is yet an additional object to provide a walking harness in several sizes that will fit a child over a number of years and as the child grows.

In order to achieve the above objects, as well as others that will become evident hereinafter, a walking harness in accordance with the present invention for children comprises a generally elongate band or strip of planar sheet material having first and second free opposing ends and including a torso-engaging portion at said first end and a trailing portion at said second end, and a transition portion located between said torso-engaging and trailing portions. Shoulder straps are provided extending from the torso-engaging portion and having remote ends generally dimensioned to extend over the shoulders of a child downwardly to a predetermined point located generally centrally between the shoulder blades of the child. Retaining means are provided for retaining said first free end of said band, said remote ends of said shoulder straps and said transition portion together at said predetermined point to create a snug fit about the torso of the child. Said trailing portion extends from said predetermined point at the back of the child to enable an adult to grip said second free end to provide a tethering for a child during walking.

The invention also addresses the method of applying a walking harness on a child of the type aforementioned, comprising the steps of initially placing the shoulder straps over the head and shoulders of the child and then placing the torso-engaging portion about the torso of a child. The first free end and shoulder strap remote ends can then be generally aligned with each other at the predetermined point on the back of the child. The first free end and the remote ends of the shoulder straps and the transition portion are then secured to each other to create a snug fit of the harness on the child. In a presently preferred embodiment, in which loops or openings are provided at the first free end and at the shoulder strap remote ends, the trailing portion is passed through the loops and the second free end is pulled through these loops to adjust the snugness of the harness on the child by adjusting the tightness applied on the trailing portion. This may be achieved by first passing the trailing portion through the loop at said first free end and subsequently through the loop at the remote ends of the shoulder straps prior to pulling on the trailing portion.

BRIEF DESCRIPTION OF THE DRAWINGS

Various further objects, features and advantages under present invention will be more fully appreciated as the invention will be better understood in light of the accompanying figures, in which:

FIG. 1 is a perspective view of a walking harness in accordance with the invention, shown on a child and remotely held by a parent or caregiver.

FIG. 2 is a top plan view of a walking harness in accordance with the invention, of the type shown in FIG. 1, when the harness is arranged in a flat plane prior to placing it on a child.

DETAILED DESCRIPTION OF THE PREFERRED EMBODIMENTS

Figure 3:
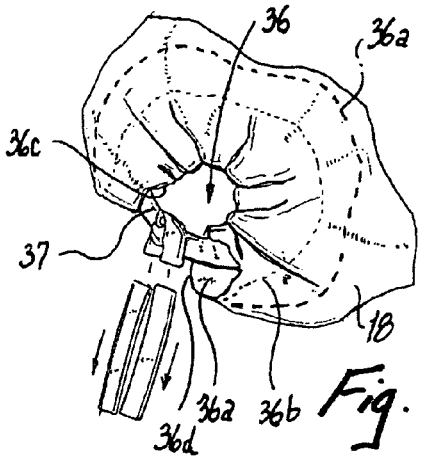
FIG. 3 is an enlarged detail showing the construction of the back opening or loop at the left end of the harness, as viewed in FIG. 2.

Referring now more specifically to the figures, in which identical or similar parts are designated by the same reference numerals throughout, and first referring to FIG. 1, a walking harness in accordance with the invention is generally designated with the reference numeral 10.

The harness 10 is shown being worn by a child 12 and being held by a parent or caregiver 14 to tether the child and allow the child to walk within a certain distance or radius of the parent or caregiver.

Referring to FIG. 2, an important feature of the invention is that the walking harness 10 is primarily formed of a generally elongate band or strip of planar sheet material 16, having a first free end 18 and an opposing second free end 20. The band or strip of material 16 includes a torso-engaging portion 22, which has a length 24 along the general direction of the band or strip 16 sufficient to substantially encircle the torso of a child. The torso-engaging portion 22 also has a width or height 26 selected to provide a sufficient surface area against the chest of the child to distribute forces applied to and thus minimize stresses on the child. Clearly, the greater the surface area, the more distributed the forces will be during use, even when the child tugs or pulls on the harness with considerable force. However, it should be clear that the specific width or height of the torso-engaging portion 22 is not critical, and any width suitable for the age or size of the child can be used.

The elongate band 16 is preferably formed of a soft fabric and also includes a trailing portion 28 and the second free end 20 that is narrower in width than the torso-engaging portion 22. Also, as will be evident from FIG. 2, the trailing portion length 30 may be, and normally is, greater than the length 24 of the torso-engaging portion 22. While the length 24 of the torso-engaging portion 22 may only be sufficient to surround the torso of the child, the length 30 of the trailing portion 28 is selected to provide a desired tethering effect and is determined by the distance or radius within which the child can move freely with respect to the parent or caregiver. In a presently preferred embodiment, the length 24 of the torso-engaging portion 22 is approximately 20" and the length 30 of the trailing portion 28 is approximately 50", however these dimensions will vary for differently-sized harnesses to accommodate differently sized children. Clearly, these dimensions can be varied without departing from the spirit or scope of the invention.

As best shown in FIG. 2, a transition portion 32 is located between the torso-engaging and trailing portions 22, 28, respectively.

Figure 3A:
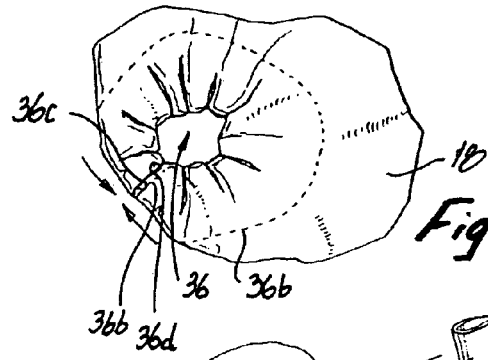
FIG. 3*a* is similar to FIG. 3, but showing the finished version of the back opening or loop.

Referring to FIGS. 2 and 3, a back loop or opening 36 is provided at the first free end 18 and a hand grip or loop 38 is provided at the second free end 20, both of which are preferably integrally formed from the elongate band 16. However, separate loops may be sewn or otherwise secured to the elongate band 16. Referring specifically to FIG. 3, the back loop or opening 36 in the preferred embodiment is formed from the edge of the fabric of the band 16 at the first free end 18 by folding an edge portion 36*a* (shown in phantom outline because folded to the reverse side of the side shown in FIG. 3) of the material to form a hem stitched with thread 36*b*. A cord 37 is passed through the hem and the free ends of the cord are pulled taut and tied together as shown to gather or bunch the fabric and adjust the size of the opening or loop 36. After the free ends are tied they may be trimmed or cut off as shown in FIG. 3 and the opposing ends or edges 36*c*, 36*d* of the hem may be butted, as suggested by the arrows in FIG. 3*a*, and sewn together to form a continuous closed loop in which the internal cord 37 becomes fully concealed. It will be appreciated that the tighter the cord is pulled the greater the gathering and the smaller the opening or loop 36. It is preferred that the opening or loop 36 be adjusted to snugly receive the second free end 20 so that once the free end is pulled through the loop 36 by the adult to initially adjust the harness about the torso of the child, as to be more fully described, the torso-engaging portion 22 is maintained in the adjusted position and is not free to slide relative to the free end 18 even during normal or anticipated movements of the child or pulling forces applied to the hand grip 38. Also, in place of the cord 37, it is possible to use an elastic band within the hem, of the type commonly found in garments about the waist. Other methods of providing a loop at the free end 18 are possible, such as sewing a separate strip to the free end.

A shoulder-engaging arrangement 40 is preferably provided to maintain the torso-engaging portion 22 at a desired position on the torso of the child and for preventing the harness from slipping downwardly on the body of the child, particularly when tension is removed from the trailing portion 28. In the presently preferred embodiment, the shoulder arrangement 40 is formed by a continuous strip forming two shoulder straps 42, 44 that cross over in the region 46 to form a shoulder loop 48. However, this specific arrangement is not critical, and the shoulder engaging arrangement 40 may also be formed of two separate straps that are attached, such as by sewing, to a separate shoulder loop.

Figure 4:
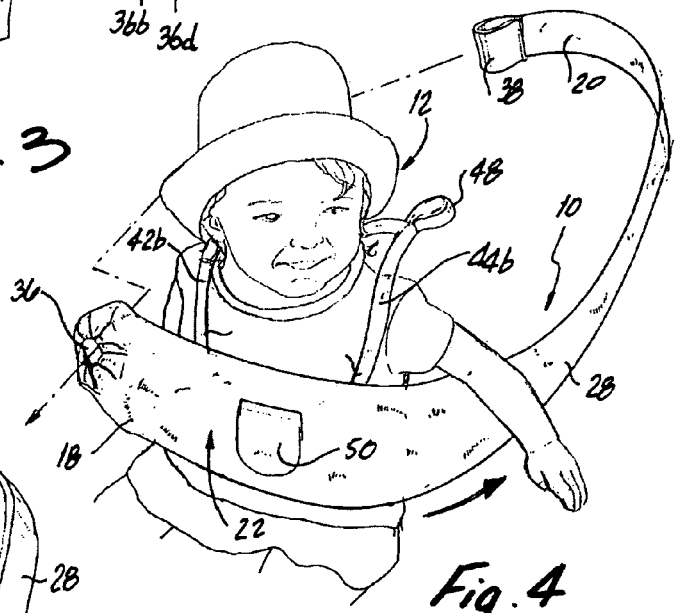
FIG. 4 is a perspective view of the harness shown in FIG. 2 applied to a child, showing the initial step of placing the shoulder straps over the head and shoulders of the child and the path for guiding the second free end of the trailing portion through the back opening or loop shown in FIG. 3.
Figure 5:
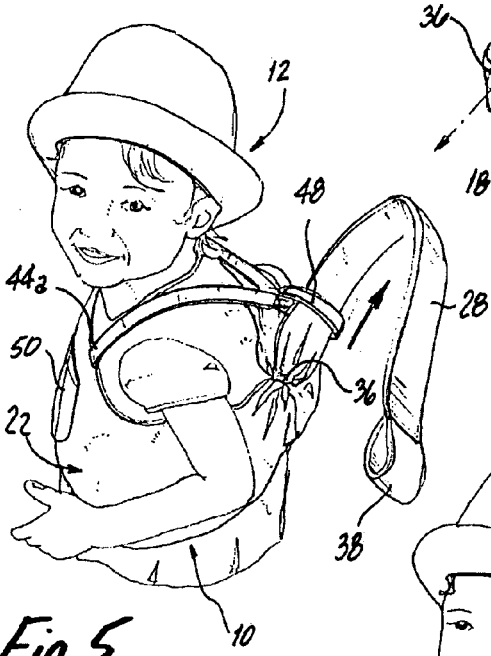
FIG. 5 is a lateral perspective view illustrating subsequent steps implementing the harness on the child by passing the second free end of the trailing portion through a shoulder loop provided at the end of the shoulder straps and tautly pulled so as to generally align with the back opening or loop at the first free end of the torso-engaging portion.
Figure 6:
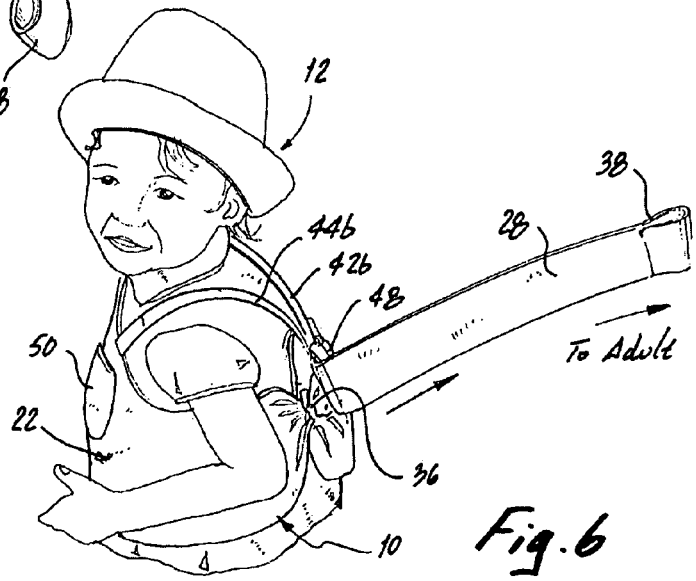
FIG. 6 is similar to FIG. 5, showing the general condition of the trailing portion during normal use of the harness.

Each of the shoulder straps 42, 44 extend from the torso-engaging portion 22, at the ends 42*a*, 44*a* (FIGS. 2, 4-6), and have remote ends 42*b*, 44*b*, the straps being dimensioned to extend over the shoulders of a child (as shown in FIGS. 4-6) and downwardly to a predetermined point located generally centrally between the shoulder blades along the back of the child.

In accordance with the broader aspects of the invention, a retaining structure is utilized for retaining the first free end 18, the remote ends 42*b*, 44*b* of the shoulder straps and the transition portion 32 together at the selected predetermined point to create a snug fit about the torso of the child. The trailing portion 28 extends outwardly from the selected predetermined point, in back of the child, to enable an adult 14 to grip the second free end 20 at the hand grip 38 and provide a tethering restraint during walking.

In the illustrated preferred embodiment, the first or back loop 36, at the first free end 18, and the second or shoulder loop 48, at the remote ends of the shoulder straps, are generally aligned with each other, after the shoulder straps are slipped over the head and back of the child, to bring both loops 36, 48 into general alignment with each other at the selected predetermined point (FIG. 5) to facilitate passage of the elongate trailing portion 28 through these loops to thereby draw the torso-engaging portion 22 and shoulder straps snugly about the child's torso when a pulling force is applied to the second free end 20 at the handgrip 38 of the trailing portion.

Optionally, the walking harness may be provided with a pocket 50 on the torso-engaging portion 22. The pocket 50 is preferably located generally centrally of the torso-engaging portion 22 to position the pocket at the front of the child.

The strip of planar material 16 may be formed of any suitable planar sheet material such as cotton fabric or cloth or any other textile material. The cotton may be, for example, a duck fabric or canvas. However, it will be clear that the specific material from which the elongate band or strip is formed is not critical for the present invention, and the specific material used can be selected to enhance the strength, durability, aesthetic appearance and/or comfort of the child. For this reason, the trailing portion, along the length 30, may be tapered as shown in FIG. 2. As long as the strip or band of material 16 is sufficiently strong, a tapered trailing portion 28 enhances the appearance of the walking harness and renders it more convenient and easier to use by the parent or caregiver 14. When tapered, the second free end 20 preferably has a width or height generally consistent with the width or height of the handgrip or loop 38, intended to be engaged or held by the user, to provide an appearance of continuity.

It should be clear that the described construction allows the harness to be made entirely from a variety of strong fabrics, and bear decorative patterns and solids. For this reason, it is also possible to line the fabric with suitable linings such as poplin fabrics (either poplin cotton or polypoplin) to enhance the aesthetic appearance of the product. The harness can be made in patterns and solids suitable for boys and girls, and may be lined with coordinating colors and patterns. When worn, the walking harness is essentially a functional garment resembling a halter or apron with a long, flowing scarf that is held by the parent or other caregiver.

It should be evident from the description that the walking harness is devoid of the hardware typically employed in connection with restraints or harnesses, such as Velcro®, snaps or locks. All of the components are made or can be made from the same or similar and coordinated fabrics. This eliminates the "dog-leash" stigma associated with the traditional versions, a stigma that has discouraged most parents from using walking harnesses despite their numerous benefits in terms of child safety and parental freedom.

The walking harness is designed in a scarf-like shape, with a shoulder strap that is placed over the child's head and has a small loop 48, the "shoulder loop". At one end of the body of the harness is the back loop 36. At the other end is the hand grip 38 that is held by the parent or other caregiver. Thus, the shoulder straps 42, 44 are initially placed over the child's head with the shoulder loop 48 extending downwardly between the child's shoulder blades. The back loop 36 is brought around the child's torso until is against the child's back. Referring to FIGS. 4-6, sequentially, the method of applying the walking harness on a child in accordance with the above description and with the invention comprises the steps of placing the shoulder straps 42, 44 over the shoulders of the child and then placing the torso-engaging portion 22 about the torso of the child. The back loop 36 is generally aligned with the shoulder loop 48, and the shoulder strap remote ends 42*b*, 44*b* are positioned at the predetermined point generally shown in FIG. 4. The first free end 18 and remote ends 42*b*, 44*b* are secured to each other to fit the harness on the child in a snug manner. Where loops 36, 48, at the first free end 18 and at the shoulder strap remote ends 42*b*, 44*b* meet, the hand grip 38, the second free end 20, and the trailing portion 28 are passed through both the back loop 36 and shoulder loop 48 and pulled through until the torso-engaging portion fits tautly about the child. Preferably, the snugness of the harness on the child is then adjusted by adjusting the tightness applied to the trailing portion 28. The trailing portion 28 is first passed through the back loop 36 at the first free end 18 and subsequently through the shoulder loop 48 at the remote ends 42*b*, 44*b* of the shoulder straps 42, 44 prior to pulling on the trailing portion 28 to make a snug adjustment to the torso-engaging portion 22 about the torso of the child.

The walking harness, in accordance with the invention, is designed in a scarf-like shape, with a shoulder strap that is placed over the child's head and having a small loop. At one end of the body torso-engaging portion 22 is a back loop, and at the other end is a handle that is held by the parent or other caregiver. The shoulder strap is placed over the child's head with the shoulder loop extending downwardly between the child's shoulder blades. The back loop is brought around the child's torso until it is against the child's back. The handle 38 is then fed through the back loop and then fed up upwards through the shoulder loop. The trailing portion 28 is then pulled by the handgrip through the back loop 36 tightly until the harness fits snugly around the child. After the handle is pulled, it extends behind the child and is held by the parent or caregiver. Neither hardware nor industrial materials is used, and the harness can be made in several sizes each of which will fit various sized children at different stages of growth. It can be used from the time the child is independently walking.

As should be clear from the foregoing, the walking harness of the present invention is strong, comfortable, lightweight and aesthetically pleasing. It is easy to use, and it can be placed on a child quickly and conveniently. Furthermore, however, the child-walking harness is stylish and bears no resemblance to traditional or conventional walking harnesses that are reminiscent of dog leashes or harnesses used in connection with domesticated animals or pets. It is expected that parents or caregivers will no longer have any difficulty or reservations in using the walking harness in accordance with the present invention.

Although the present invention has been described in some detail by way of illustration and example for purposes of clarity and understanding, it will, of course, be understood that various changes and modifications may be made in the form, details, and arrangements of the parts without departing from the scope of the invention.

We claim:

1. A walking harness for children comprising:

a generally strip of planar sheet material including a first free end with an opening, an opposing second free end, a torso-engaging portion locates next to said first free end, a trailing portion locates next to said opposing second free end, and a transition portion located between said torso-engaging and trailing portions;

shoulder straps extending from said torso-engaging portion wherein said shoulder straps cross over in a region to form a shoulder loop and that said shoulder straps extend over the shoulders of a child downwardly to a predetermined point located generally centrally between the shoulder blades of the child;

retaining means for retaining said first free end, said shoulder loop, and said transition portion together at said predetermined point to create a snug fit about the torso of the child, wherein said retaining means is formed by aligning said opening and said shoulder loop with each other at said predetermined point and inserting said trailing portion through said opening and said shoulder loop and extending said trailing portion from said predetermined point to enable an adult to draw said torso-engaging portion and said shoulder straps snugly fitted about the torso of the child by pulling to said opposing second free end.

2. A walking harness for children as defined in claim 1, wherein said strip of planar sheet material is formed of cotton.

3. A walking harness for children as defined in claim 2, wherein said cotton comprises a duck fabric.

4. A walking harness for children as defined in claim 1, wherein said strip of planar sheet material is formed of a canvas material.

5. A walking harness for children as defined in claim 1, wherein said torso-engaging portion has a substantially uniform width.

6. A walking harness for children as defined in claim 1, wherein at least said trailing portion is generally tapered to provide a reduced width at said second free end.

7. A walking harness for children as defined in claim 1, wherein said strip of planar sheet material is the nature of a scarf.

8. A walking harness for children as defined in claim 1, wherein said retaining means includes means for tightening said torso-engaging portion with increasing tension applied to said trailing portion.

9. A walking harness for children as defined in claim 1, further comprising gripping means for facilitating gripping of said opposing free end.

10. A walking harness for children as defined in claim 9, wherein said gripping means comprises a handle.

11. A walking harness for children as defined in claim 10, wherein said handle comprises a loop.

12. A walking harness for children as defined in claim 1, further comprising a pocket on said torso-engaging portion.

13. A walking harness for children as defined in claim 12, wherein said pocket is located generally centrally on said torso-engaging portion to be positioned on the front of the child when the harness is placed on the child.

14. A walking harness for children as defined in claim 1, further comprising a lining for lining said strip of planar sheet material to provide a finished appearance to the harness.

* * * * *